United States Patent [19]

Wilmeth

[11] 4,308,767

[45] Jan. 5, 1982

[54] STUD WRENCH

[75] Inventor: Claude H. Wilmeth, Montgomery, Tex.

[73] Assignee: N-S-W Corporation, Austin, Tex.

[21] Appl. No.: 206,909

[22] Filed: Nov. 14, 1980

Related U.S. Application Data

[63] Continuation of Ser. No. 72,270, Sep. 4, 1979, abandoned.

[51] Int. Cl.[3] ..... B25B 13/46

[52] U.S. Cl. ..... 81/57.39; 81/53.2

[58] Field of Search ..... 81/57.39, 57.19, 53.2

[56] References Cited

U.S. PATENT DOCUMENTS

| | | | |
|---|---|---|---|
| 3,844,547 | 10/1974 | Lang et al. | 81/57.19 |
| 4,082,017 | 4/1978 | Eckel | 81/57.19 |
| 4,091,890 | 5/1978 | Wilmeth et al. | 81/57.39 |
| 4,132,136 | 1/1979 | Wilmeth | 81/57.39 |

FOREIGN PATENT DOCUMENTS

| | | | |
|---|---|---|---|
| 2749857 | 10/1979 | Fed. Rep. of Germany | 81/57.39 |
| 972449 | 10/1964 | United Kingdom | 81/57.39 |
| 258158 | 8/1968 | U.S.S.R. | 81/57.39 |

*Primary Examiner*—James L. Jones, Jr.
*Attorney, Agent, or Firm*—Michael P. Breston

[57] ABSTRACT

The wrench for wrenching a shaft or stud comprises a housing having a longitudinal recess therein for mounting the housing over the shaft to be turned. A pawl is pivotably connected to the housing. A first clamping jaw is slidably mounted in the recess. A second jaw is slidably mounted in the recess. The first jaw is disposed for limited rotational and translational movement within the recess so as to open the clamping jaws to allow the tool wrench to be mounted over or to be removed from the shaft. A wrenching actuator is connected to the pawl arm for turning the pawl clockwise and counter-clockwise about the pawl's pivot. A clamping actuator is mounted on the housing for turning the pawl to thereby initially securely clamp the jaws about the shaft to be turned. Wrenching of the shaft can then be accomplished with the wrenching actuator by applying a torque on the pawl in a direction so as to increase the clamping force produced by the jaws and to rotate the shaft together with the housing.

15 Claims, 11 Drawing Figures

STUD WRENCH

This is a continuation of application Ser. No. 072,270 filed on Sept. 4, 1979, now abandoned.

BACKGROUND OF THE INVENTION

There are numerous applications, for example, in turbine split casings for power generation, wherein a very high torque must be applied to a stud to rotate the same. No effective wrench is known for wrenching such studs. Accordingly, torches and similar awkward means must presently be used to remove the studs. This is a very time-consuming, expensive, and destructive operation.

High torque ratchet wrenches and related prior art are described in U.S. Pat. Nos. 4,091,890 and 4,132,136, assigned to the same assignee. Such ratchet wrenches for loosening or tightening nuts and bolts do not lend themselves for wrenching applications such as described above, because the required high torques would produce substantial bending and tensile forces in the housing of the ratchet wrench, requiring such housing to be made very large and heavy to maintain its structural integrity. Also, conventional ratchet wrenches would not develop a sufficient prior clamping force on the stud to be wrenched, so that the required torque could not be effectively transmitted to and maintained on the stud.

Drill pipe tongs are also well known and are used in making up or breaking apart drill pipe joints. Typical such tongs are described in U.S. Pat. Nos. 4,082,017 and 3,844,547. Such tongs include hydraulically or pneumatically powered upper and lower tongs which are swivelly connected for a scissoring action. Each of the tongs typically includes a door that is hingedly mounted at one edge and is provided with a latch at the other edge to enable the door to be swung to a completely open position for removal of the tongs from the drill pipe when desired.

SUMMARY OF THE INVENTION

The tool wrench for wrenching a stud or shaft comprises a housing having a longitudinal recess therein for mounting the housing over the shaft to be turned. A pawl is connected to the housing for rotation about a pivot having an axis parallel to the axis of the shaft to be turned. A first clamping jaw is slidably mounted in the recess. This jaw has a toothed concave face for clamping an arcuate portion of the shaft, and a convex arcuate wall engageable by a concave matching wall in the pawl, whereby the pawl is adapted to exert a torque on the shaft through the first jaw. A second jaw is slidably mounted in the recess and has a toothed concave face for clamping a diametrically-opposed arcuate portion of the shaft. The first jaw is disposed for limited rotational and transversal movement within the housing recess so as to open the clamping jaws, thereby to allow the tool wrench to be mounted over or to be removed from the shaft. A wrenching actuator is connected to the pawl yoke for turning the pawl clockwise and counter-clockwise about the pawl's pivot. A clamping actuator is mounted on the housing for turning the pawl and the housing in a scissoring action, thereby to securely clamp the pair of jaws about the shaft prior to wrenching the shaft with the wrenching actuator. The wrenching actuator applies a torque on the pawl in a direction so as to increase the initial clamping force produced by the clamping actuator on the jaws, and to rotate the shaft together with the housing.

DESCRIPTION OF THE PREFERRED EMBODIMENT

Figure 1:
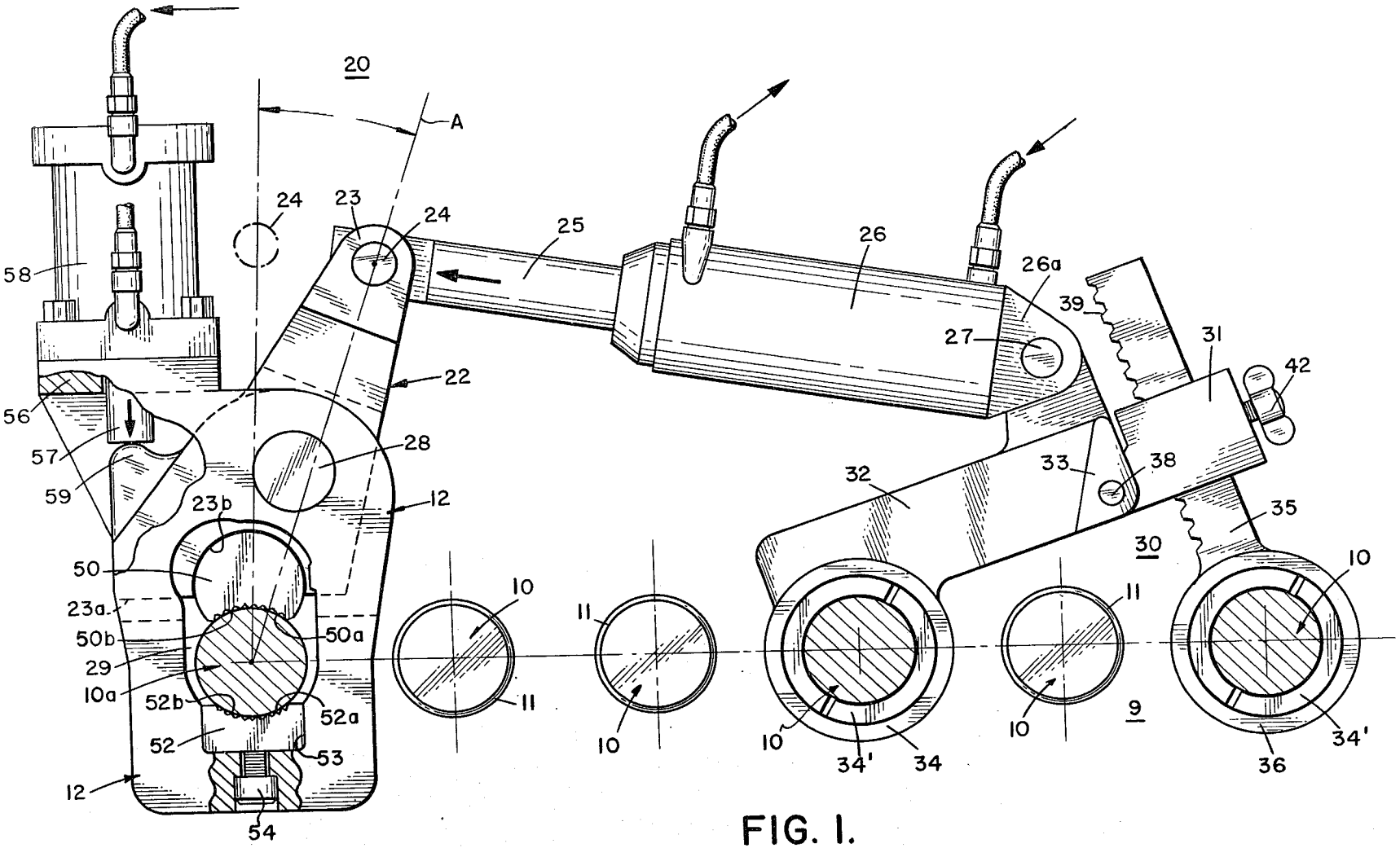
FIG. 1 is a front view in elevation, partly in section, of a preferred embodiment of the stud wrench assembly.
Figure 2:
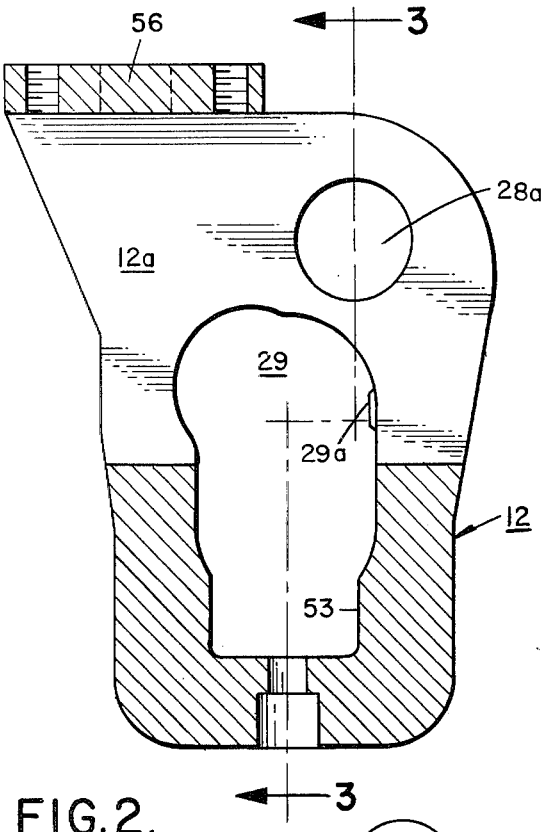
FIG. 2 is a sectional view taken on line 2—2 of the wrench shown in FIG. 1.
Figure 3:
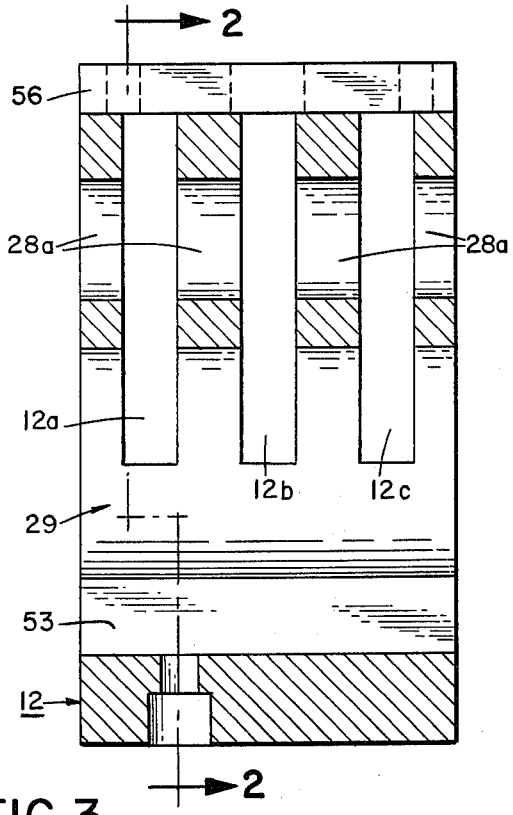
FIG. 3 is a sectional view taken on line 3—3 of the wrench shown in FIG. 2.
Figure 4:
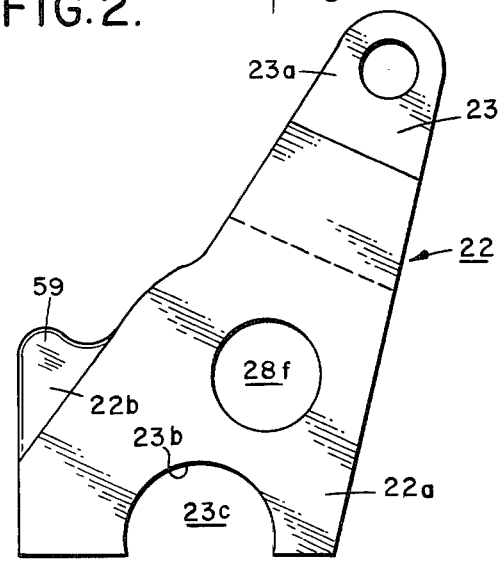
FIG. 4 is a front view of the pawl.
Figure 5:
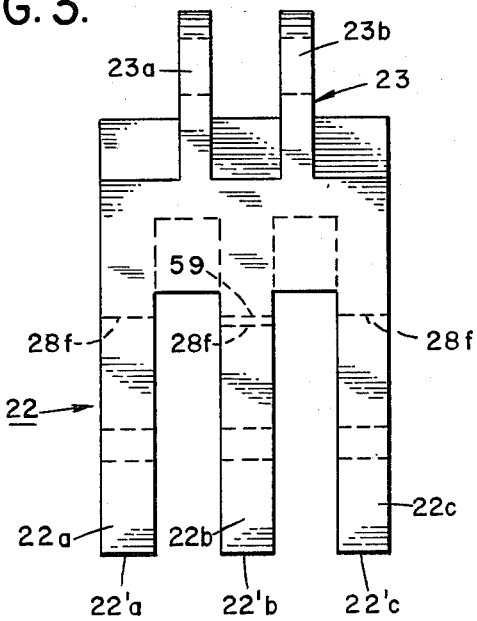
FIG. 5 is a side view of the pawl shown in FIG. 4.
Figure 9:
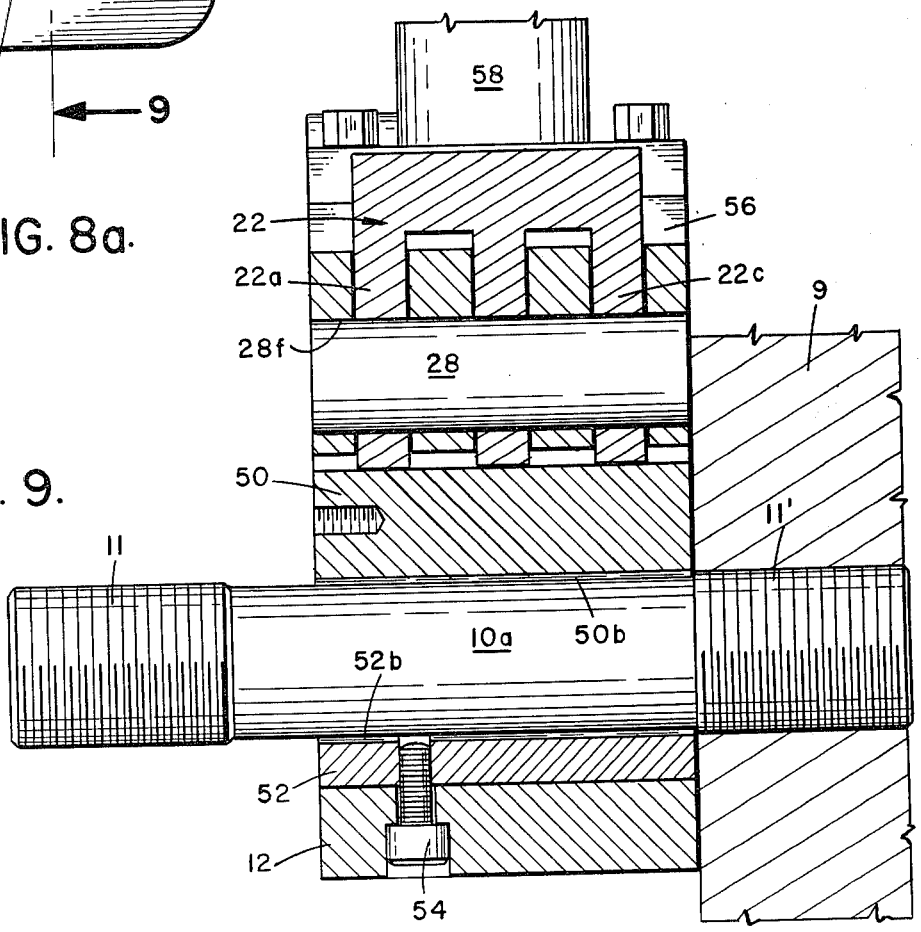
FIG. 9 is an enlarged sectional view taken on line 9—9 of FIG. 8*a*.

With reference in particular to FIGS. 1 and 9, there are shown a plurality of studs 10 which carry at their opposite ends threads 11, 11'. The threaded ends 11 are shown to threadedly engage a flange 9, such as that of a turbine split casing used for high power generation. While the invention is suitable for such studs, however, it should be understood that it is applicable to any rod or shaft whether threaded or not which requires to be wrenched. The word "shaft" is therefore used in its fullest generic sense so as to include any rotatable member. The wrench of this invention is especially characterized in that it can be mounted over the end of a shaft in completely encircling relation, as will become subsequently apparent.

As depicted in FIGS. 1–5 and 9, the improved stud wrench, generally indicated by the reference numeral 20, includes a pawl, generally designated as 22, attached at its outer yoke 23 to a drive pin 24 which is connected to the ram 25 of a wrenching actuator which can be a hydraulic cylinder 26. Pawl 22 pivots on a pivot pin 28 supported by the wrench housing 12. Housing 12 has a center recess 29 of a predetermined configuration.

The pawl 22 thus presents its longitudinal length in a horizontal plane perpendicular to the longitudinal axis of the stud 10*a* over which housing 12 is mounted. Wrenching actuator 26 in its power stroke serves to forcefully rotate stud 10*a* together with housing 12. The casing end 26*a* of the cylinder 26 is pivotably secured by a pivot 27 to a reaction-support structure 30 which includes a discreetly adjustable clamp 31 adapted for discreetly varying the angular position of the actuator 26 to distinctly different patterns of studs 10, while maintaining intact the pivotal connection on pivot 27.

In any operable position of the reaction-support structure 30 within the provided adjustability range, a substantially-perpendicular angular relationship will be established between the axis of rod 25 and the line A joining the axes of stud 10*a* and of pin 24. With this perpendicular relationship, maximum torque will be exerted on stud 10*a*, as more fully explained in said U.S. Pat. No. 4,132,136.

The reaction-support structure 30 further comprises: an anchor leg 32 having a head portion 33 at its inner end and an anchor ring 34 at its outer end, and a back-up leg 35 having a reaction ring 36 at one end thereof and the locking clamp 31 disposed longitudinally therealong. Clamp 31 is discreetly movable longitudinally on the back-up leg 35. The clamp 31 carries a pivot 38 for establishing the pivotal connection with the anchor leg 32. The back-up leg 35 carries a rack 39 extending longitudinally on the inner side thereof. Rack 39 has a plurality of teeth, and the clamp 31 carries at one side internal matching teeth. The clamp's opposite side can be secured to the back-up leg by a hand-operated bolt 42.

Since the anchor rings 34, 36 must have an inner diameter which is slightly larger than the outer diameters of the threaded end portions 11' on the studs 10 used as anchors, there is provided for each one of rings 34, 36 a split sleeve 34' which more snugly fits around the unthreaded solid portions of the studs.

As a result of these linkages, pressurization of the drive actuator 26 causes the pawl 22 to pivot clockwise and counter-clockwise on pin 28. The end **23*a* of pawl 22 inside housing 12 defines a cylindrical wall 23*b***.

A vertically-extending (as viewed in FIG. 1) clamping jaw 50 is removably insertable into the semi-cylindrical opening **23*c* (FIG. 4) of pawl 22. Correspondingly, a second clamping jaw 52 is diametrically positioned in a rectangular slot 53 (FIG. 2) formed as part of recess 29 within the housing 12. Jaw 50 can rotate or oscillate relative to pawl 22 and move sideways or transversely relative to housing 12, while jaw 52 can neither rotate nor move sideways relative to housing 12. Both jaws 50 and 52 can be positioned in and lifted out from the recess 29 only in the axial direction. Jaw 52 is securable to the housing 12 by a key retainer bolt 54**.

The clamping jaws 50, 52 are formed with cylindrical surfaces **50*a*, 52*a*, respectively, which have the same radius. In their clamping and torquing positions, jaws 50, 52 are diametrically opposite from each other. Jaw teeth 50*b*, 52*b* reside in surfaces 50*a*, 52*a***, respectively, in facing relation to one another.

A mounting platform 56 is provided on the upper end of housing 12. A hydraulic cylinder 58, acting as a clamp actuator, has its ram 57 positioned to move towards and away a cam shoulder 59 on the plate of pawl 22.

The pawl 22 is rotated clockwise (as viewed in FIG. 7) by an angle b about the axis of the pawl pivot 28 by the retraction of rod 25 in drive actuator 26 to open jaws 50, 52. The stud wrench 20 is then movable over and removable from the stud **10*a*. When the clamping actuator 58 is in its retracted position, the drive actuator 26** is also in its retracted position.

Figure 6:
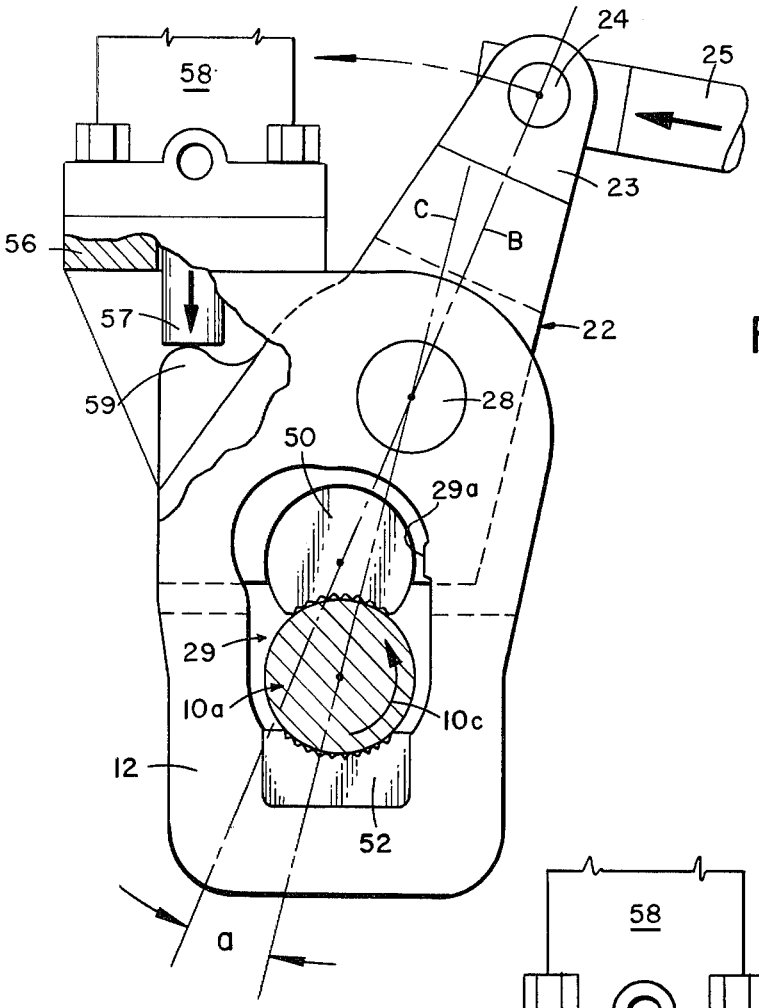
FIG. 6 is a front view of the wrench and of the pawl without the actuators and with the wrench shown in its torquing condition.
Figure 7:
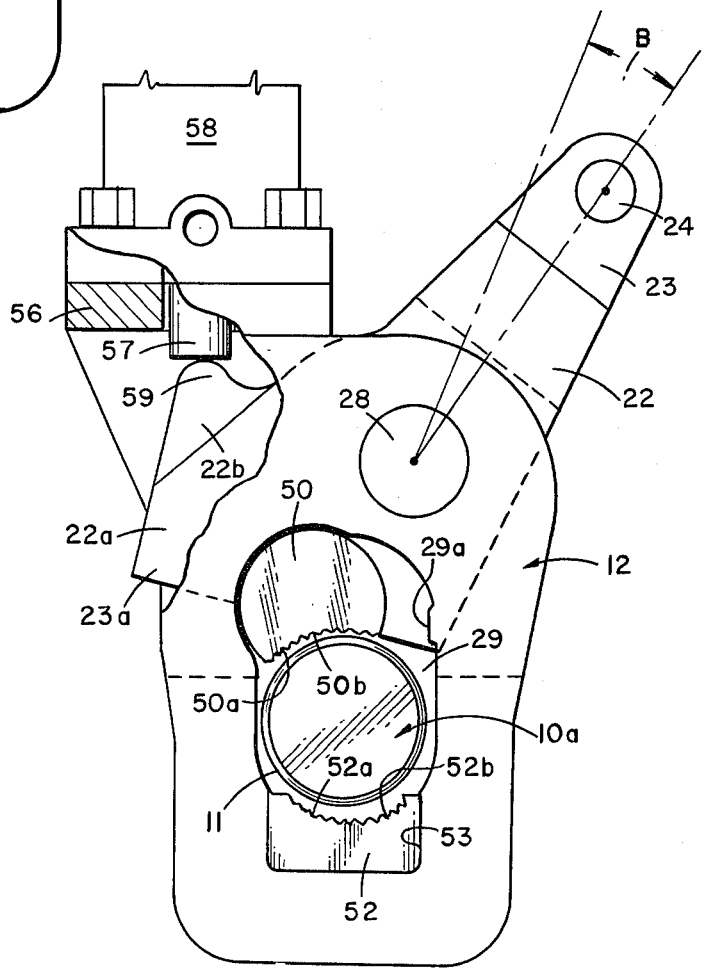
FIG. 7 is a view similar to FIG. 6 but with the wrench shown in its relaxed condition just prior to starting the torquing operation.
Figure 8A:
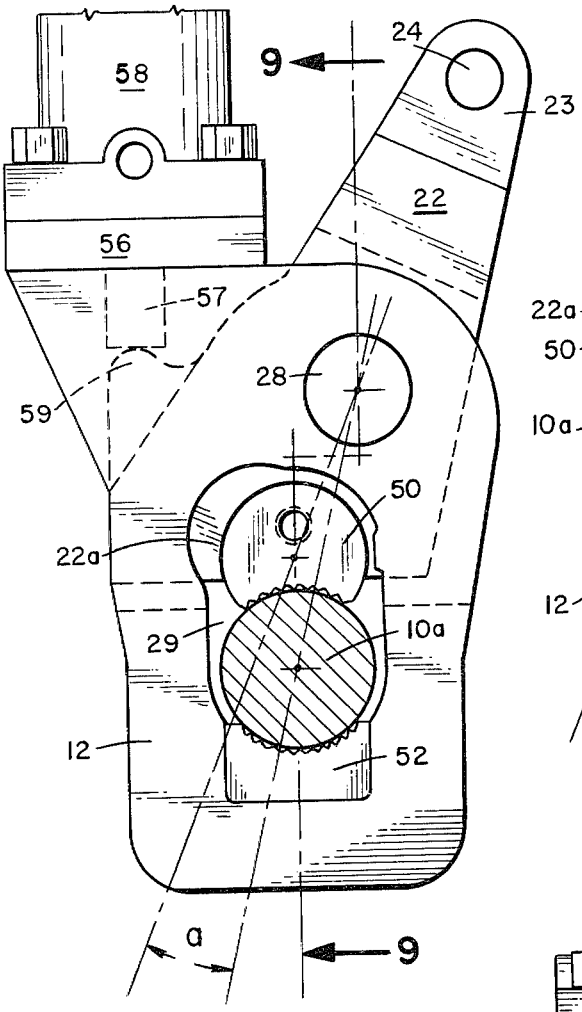
FIGS. 8*a*–8*c* are front views of the wrench showing distinct shapes for the jaws for clamping different diameter studs.
Figure 8B:
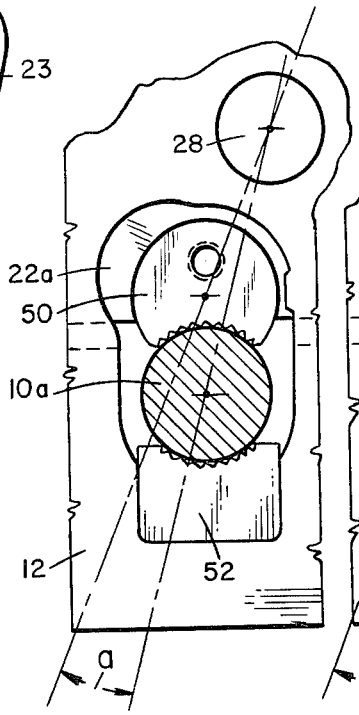
Figure 8C:
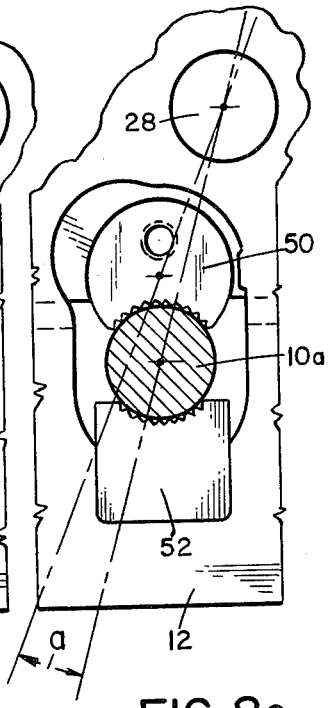

The extension of ram 57 (from its position as shown in FIG. 7 to its position as shown in FIG. 1) causes pawl 22 to rotate counter-clockwise, and housing 12 to rotate clockwise in a scissoring motion. The upper jaw 50 then moves to the right (as viewed in FIG. 6) towards stud **10*a* so that jaws 50 and 52 assume their clamping closed position. Pivot 24 is kept stationary by piston rod 25. The movement of jaw 50 is limited by the wall protrusion 29*a* projecting into recess 29. Thus, the stop means 29*a* in the housing 12 limit the maximum transverse movement of jaw 50 in response to the extension of ram 57**.

When the ram 57 of the hydraulic clamping cylinder 58 becomes extended, pawl 22 rotates counter-clockwise about stationary pivot 24, as viewed in FIG. 7, by the same angle b until the jaws 50, 52 close (FIG. 6). Jaw 50 has to rotate slightly counter-clockwise about its longitudinal axis and move transversely or sideways to the right (as viewed in FIG. 7) in order to grip the stud.

The clamping action produced by ram 57 on cam 59 is transmitted to the stud by the teeth of the jaws 50, 52. At this time, pawl 22, housing 12, and jaws 50, 52 are locked with stud **10*a* and will rotate together. The extension of ram 25 therefore causes stud 10*a* to rotate in a counter-clockwise direction, as shown by the arrow 10*c* (FIG. 6). The rotation of the stud 10*a* entrains the rotation of housing 12 therewith. Both will rotate by an angle dependent on the stroke of the piston rod 25 of drive cylinder 26. After stud 10*a* is fully rotated, both the piston rod 57 of clamping cylinder 58 and piston rod 25 of drive cylinder 26 are moved to their fully retracted positions, which completes a full cycle of operation. The clamping and torquing cycle can then start over again. The jaw teeth are forced radially inwardly onto the stud 10*a* by the clamping action of cylinder 58 and this clamping action is then augmented by the torque produced by the clamping action resulting from the drive cylinder 26**.

One of the salient features of the stud wrench 20 is the rotational and sideways motions of the upper jaw 50. Jaw 50 is mounted for limited sideways movement so as to ensure an optimum and safe total clamping force exerted by the cylinders 26 and 58 through the clamping jaws 50, 52 on the stud **10*a*. This clamping force depends on the angle a (FIG. 6) between Line B joining the axes of pivot 28 and jaw 50, and Line C joining the axes of pivot 28 and stud 10*a*. If angle a is too small, the total clamping force will become too high (theoretically reaching infinity for angle a equal to 0°); if angle a is too large the total clamping force will be insufficient for the drive cylinder 26 to rotate stud 10*a***. It was found, therefore, that angle a is critical and should be within a range between 2° and 15°. The preferred range for angle a is between 3° and 6°.

In the preferred embodiment, pawl 22 has a yoke 23 formed by a pair of ears **23*a*, 23*b* (FIG. 5), and the body of pawl 22 has at least two, put preferably three or five side plates 22*a*–22*c*. These plates have thereacross aligned pivot holes 28*f* within which the pivot pin 28 is rotatably mounted. The free end faces 22'*a*–22'*c* of the plates constitute the contact surface 23*b* contacting the first jaw 50. The body of housing 12 has matching recesses 12*a*–12*c* (FIG. 3) for slidably accepting therein the corresponding pawl's plates 22*a*–22*c* (FIG. 9**). With this construction the clamping and shear forces become distributed instead of being concentrated.

An important advantage is the scissoring motion of pawl 22 and housing 12 during the initial clamping operation produced by actuator 58, which allows piston rod 25 to remain fully retracted for most efficient operation.

The slidable jaw construction also allows the tool wrench 20 to accommodate various sizes of jaws and studs, as better illustrated in FIGS. **8*a*–8*c* from which it will be seen that the dimensions of both jaws 50, 52** must change for different diameter studs to maintain angle a within its critical range.

In addition, the wrenching actuator 26 and the clamping actuator 58 can be controlled manually, or preferably with suitable valves together with a fluid system, thereby alleviating the possibility of injury due to handling and improving safety throughout operation.

What is claimed is:

1. In a tool wrench for wrenching a shaft, the combination comprising:

a housing having an axial recess therein;

a pawl having a yoke at one end, said pawl being connected to said housing for rotation about a pawl pivot;

a first clamping jaw in said recess for clamping a portion of said shaft;

a second clamping jaw in said recess for clamping a diametrically-opposed portion of said shaft;

a wrenching actuator having a pivot connected to the pawl yoke for rotating said pawl in one direction thereby to open said jaws;

a clamping actuator mounted on said housing for turning said pawl in an opposite direction thereby to close said jaws, whereby said pawl, said housing, and said jaws become locked for simultaneous forced rotation with said shaft; and said wrenching actuator torquing said pawl in said opposite direction, while said clamping actuator produces its clamping action, thereby to simultaneously rotate said jaws, said housing, and said shaft.

2. In a tool wrench for wrenching a shaft, the combination comprising:

a housing having an axial recess therein;

a pawl having a yoke at one end, said pawl being connected to said housing for rotation about a pawl pivot;

a first clamping jaw in said recess, said first jaw having a toothed face for clamping a portion of said shaft;

a second clamping jaw in said recess, said second jaw having a toothed face for clamping a diametrically-opposed portion of said shaft;

said first jaw being disposed for limited sideways movement within said recess so as to open said clamping jaws to allow said tool wrench to be mounted over or to be removed from said shaft to be wrenched;

a wrenching actuator having a pivot connected to the pawl yoke for rotating said pawl in one direction thereby to open said jaws;

a clamping actuator mounted on said housing for turning said pawl in an opposite direction thereby to close said jaws and to clamp said jaws to said shaft, whereby said pawl, said housing, and said jaws become locked for simultaneous forced rotation with said shaft; and said wrenching actuator torquing said pawl in said opposite direction, while said clamping actuator produces its clamping action, thereby to simultaneously rotate said jaws, said housing, and said shaft.

3. The tool wrench of claim 2, wherein said pawl has at least three parallel plates for operatively engaging said first jaw, and said housing has at least three recesses for movably accepting said plates therein.

4. The tool wrench of claim 1, wherein the movement of said first jaw in said recess is limited by the side wall of said recess.

5. The tool wrench of claim 2, wherein said second jaw is limited for movement in an axial direction parallel to the axis of said shaft.

6. The tool wrench of claim 3, wherein said wrenching actuator is a fluid-operated cylinder, said clamping actuator is a fluid-operated cylinder, each cylinder having a piston rod, the piston rod of said clamping cylinder being adapted to exert a force on the center plate of said pawl, and the piston rod of said actuator cylinder being pivotably connected to said pawl yoke.

7. The tool wrench of claim 6, wherein the angle, between the line joining the axis of the pawl's pivot on the pawl yoke and the axis of the first jaw, and the line joining the axis of said pawl's pivot and the axis of the shaft being turned, has a predetermined value.

8. The tool of claim 7, wherein said angle has a value between 2° and 15°.

9. The tool of claim 7, wherein said angle has a value between 3° and 6°.

10. A power wrench assembly comprising:

a wrench member defining an aperture for loosely receiving a member to which torque is to be applied by the wrench assembly;

a pawl pivotably connected with the wrench member, the pawl having an outer end projecting outwardly from the wrench member, and an inner end extending into the aperture;

a pair of jaws being provided in the aperture whereby, in use of the assembly, one of the jaws is disposed between the inner end of the pawl and one side of the member to which torque is to be applied and the other jaw is disposed between the wrench member and an opposite side of the member;

a clamp actuator being mounted on the wrench member and having a ram which is adapted to push against the pawl to cause the pawl to rotate relatively to the wrench member, whereby the jaws are forcibly clamped to the member to which torque is to be applied; and a wrench driver being coupled to the outer end of the pawl for applying a torque to the clamped jaws and to the member.

11. A wrench assembly as claimed in claim 10, in which each jaw has a toothed face for engagement with the member to which torque is to be applied, and in which the said one jaw is mounted for limited lateral movement within the aperture so as to permit release of the jaws from the member and to allow the wrench member to be mounted over or to be removed from the member.

12. A wrench assembly as claimed in claim 11, in which the pawl has at least three parallel plates for operatively engaging the said one jaw, the wrench member having at least three recesses for movably receiving the plates.

13. A wrench assembly as claimed in claim 12, in which the aperture has a stop shoulder for limiting the movement of the said one jaw in the aperture.

14. A wrench assembly as claimed in claim 13, in which the said other jaw is limited for movement in an axial direction parallel to the axis of pivotal movement between the pawl and the wrench member.

15. In a tool wrench for wrenching a member, the combination comprising:

a housing having an axial recess therein;

a pawl having a yoke at one end, said pawl being connected to said housing for rotation about a pawl pivot;

a first clamping jaw in said recess for clamping a portion of said member;

a second clamping jaw in said recess for clamping an opposite portion of said shaft;

a wrenching actuator adapted to be coupled to said pawl yoke for rotating said pawl in one direction thereby to open said jaws; and a clamping actuator for turning said pawl in an opposite direction thereby to close said jaws.

* * * * *